US007162954B1

(12) United States Patent
Helfenstein et al.

(10) Patent No.: US 7,162,954 B1
(45) Date of Patent: Jan. 16, 2007

(54) DETERMINATION OF CUTTING POSITIONS OF WEB STRANDS IN A ROTARY PRINTING PRESS

(75) Inventors: Andreas Helfenstein, Zürich (CH); Reinhold Güth, Oberrohrdorf (CH)

(73) Assignee: Maschinenfabrik Wifag (CH)

( * ) Notice: Subject to any disclaimer, the term of this patent is extended or adjusted under 35 U.S.C. 154(b) by 0 days.

(21) Appl. No.: 09/630,625

(22) Filed: Aug. 1, 2000

(30) Foreign Application Priority Data

Aug. 2, 1999 (DE) ..... 199 36 291

(51) Int. Cl.
*B41F 13/56* (2006.01)

(52) U.S. Cl. ..... 101/226; 101/219

(58) Field of Classification Search ..... 101/226, 101/227, 219, 216, 483–485
See application file for complete search history.

(56) References Cited

U.S. PATENT DOCUMENTS 4,896,605 A * 1/1990 Schroder ..... 101/486
5,016,182 A * 5/1991 Bergland et al. ..... 700/125
5,119,725 A * 6/1992 Okamura ..... 101/226
5,123,316 A 6/1992 Niedermaier et al. ..... 83/29
5,390,599 A * 2/1995 Matsumoto et al. ..... 101/226
5,449,156 A * 9/1995 Gnuechtel et al. ..... 270/5.02
5,458,062 A * 10/1995 Goldberg et al. ..... 101/485
5,699,735 A * 12/1997 Stein et al. ..... 101/219
5,876,784 A * 3/1999 Hesselmann ..... 427/8
5,901,647 A * 5/1999 Kohlmann ..... 101/216
5,915,301 A * 6/1999 Pollock ..... 101/227
6,092,466 A * 7/2000 Koch et al. ..... 101/485
6,193,640 B1 * 2/2001 Weis ..... 493/346
6,311,922 B1 * 11/2001 Beisswanger et al. ... 242/542.3

FOREIGN PATENT DOCUMENTS

DE 36 02 894 A2 8/1987

* cited by examiner

*Primary Examiner*—Anthony H. Nguyen
(74) *Attorney, Agent, or Firm*—McGlew & Tuttle, PC

(57) ABSTRACT

A process is disclosed for determining cutting positions of web strands (B1, B2), which are brought together into a strand to be bound (H1) in a rotary printing press and cross-cut. A measured value for the cutting position of the web strands (B1, B2) is formed in the strand to be bound (H1) and one individual strand measured value for the cutting positions of the web strands (B1, B2) is recorded for each of the web strands (B1, B2) before bringing together. The cutting positions of the web strands (B1, B2) are determined from the individual strand measured values and the common measured value recorded for the web strands (B1, B2) of the strand to be bound (H1) in the strand to be bound (H1).

13 Claims, 6 Drawing Sheets

DETERMINATION OF CUTTING POSITIONS OF WEB STRANDS IN A ROTARY PRINTING PRESS

FIELD OF THE INVENTION

The present invention pertains to a process and a device for determining the cutting positions of web strands, which are brought together into a strand to be bound and cross-cut in a rotary printing press, especially a web-fed rotary printing press. A measured value for the cutting position of the web strands is recorded in the strand to be bound and is used to determine the cutting positions of the web strands. Furthermore, the present invention pertains to a process and a device for controlling the cutting positions of the web strands.

BACKGROUND OF THE INVENTION

After printing on material webs intended for printing in a rotary printing press, the individual web strands are brought together at a collection roller into one or more strands to be bound or stitched (connected). One strand to be bound runs over a folding hopper into a folder, in which the strand to be bound is cut at right angles to the direction of delivery by a cutting cylinder. The position of this cut relative to the printing style on the printed web is an important variable in the production of a printed product. The measurable length of the printing style relative to the position of the cutting cylinder is called the cutting position. The cutting position is usually set at the beginning of a production, but it must be continually adjusted during the running production. The cutting position is changed by a so-called register mechanism, which is arranged before the web strands are brought together. The register mechanism typically consists of main and secondary registers. A register for the strand to be bound, which is arranged after the individual web strands have been brought together, may additionally be used as well. The cutting position for a web strand is set by a change in the length of the path of the web. To control the register means, measured values for the cutting positions of the web strands are recorded and evaluated in terms of control engineering in order to control the register means.

It has been known that measured values for the cutting positions of the web strands can be recorded by means of optical sensors. The crop mark is usually set by the printer correctly at the control station, after which the control is switched on and the cutting position is determined at the sensor during the first revolution and stored. The control subsequently checks during each revolution whether the cutting position has shifted in relation to the position stored during the first revolution. If it has, the control calculates a correction signal, which again displaces the cutting position at the sensor in the direction of the desired position being stored.

The optical sensors used to determine measured values for the cutting positions of the web strands are arranged in an area located in front of the area in which the individual web strands are brought together. The printed webs usually still travel over a considerable distance from this measuring point to the cutting cylinder. This in turn implies a considerable potential of disturbance in the cutting positions of every individual web strand. The path of the web from the site of the measurement to the cutting cylinder is, in general, so long that cutting position deviations in the millimeter range will result in the usual printing operation. For example, a change in the stretching of the web during production between the site of the measurement and the cutting cylinder in the folder leads to a change in the cutting position because the cutting position at the sensor is maintained by the controller at a constant value and the number of images located between the sensor and the cutting cylinder will no longer be correct now. The stretching of the web may change due to a difference in ink application; in addition, it also depends on the humidity of the ambient air. Another problem is represented by control units, which, when viewed in the direction of travel of the paper web, are arranged after the sensor, e.g., a register for the strand to be bound. Adjustments with such control units do not become visible in the measured signal, but they do cause a change in the cutting position. However, what disturbs the cutting position in practice is above all the change from one speed of rotation to another. This happens, e.g., at the time of the start-up of a press, or after a paper break. The farther away the sensors are located from the cutting cylinder, the more noticeable are such effects as deviations in the cutting position.

A process in which sensors can be arranged at a short distance in front of the cutting cylinder has been known from DE 195 06 774 A1. The measurement of the cutting positions of the web strands is thus performed in the strand to be bound, i.e., after the individual web strands have been brought together. A reference mark consisting of a magnetizable special ink is applied to every individual printed web during the printing operation. These reference marks are themselves magnetized during running through an external magnetic field and can be subsequently recognized by a magnet sensor. The advantage of this method is that measurement values can be determined for the cutting positions of the web strands even in the web strands that are covered by other web strands after they have been brought together and are thus invisible to optical sensors. The magnetic fields of the reference marks must be only strong enough to penetrate the superjacent web strands. The magnet sensors may be arranged, laterally offset, directly in front of the cutting cylinder, and thus they recognize any change in the cutting position. A marking means is necessary for applying reference marks, and a magnetizing means is necessary for the reference marks applied. Space for installing a plurality of sensors must be present at a short distance in front of the cutting cylinder.

SUMMARY AND OBJECTS OF THE INVENTION

The basic object of the present invention is to determine the cutting positions of web strands and to reduce the effort needed for this compared with the above-described state of the art without substantially reducing the precision.

According to the invention, a process is provided for determining the cutting positions of web strands, which are brought together into a strand to be bound or stitched (connected) in a rotary printing press and are cross-cut. A measured value for the cutting position of the web strands is recorded in the strand to be bound and is used to determine the cutting positions of the web strands. The process includes recording one individual strand measured value for the cutting positions of the web strands for each of the said web strands, before bringing together. The cutting positions of the web strands are determined from the individual strand measured values and the common measured value determined for the web strand of the strand to be bound in the strand to be bound.

According to the invention, a device for determining cutting positions of web strands is provided, which web strands are brought together into a strand to be bound in a rotary printing press and are cross-cut, wherein a measured value for the cutting positions of the said web strands in the strand to be bound is recorded by means of at least one sensor for the strand to be bound. The device records individual strand measured values for the cutting positions of the web strands for the web strands individually by said web strand sensors before the web strands are brought together.

It was discovered that beginning from the last measuring point that is possible for optical sensors before the webs are brought together, changes or disturbances concerning the cutting positions of web strands affect all web strands equally together. Beginning from the point at which the web strands are brought together and then lie on one another, the web strands are displaced in relation to one another to a practically negligible extent only. Disturbances in the cutting position affect all web strands equally. To determine a deviation of the cutting position of the web strands that arises over the section between the measurement of the cutting positions before the webs are brought together and the cutting cylinder, it is sufficient to determine the cutting position of an individual web strand in the strand to be bound. The cutting position of an outermost web strand is preferably determined or measured.

This basic assumption reflects the actual fact in a simplified manner. If, e.g., the web tension of a first web strand and consequently the stretching of this incoming web strand changes, this may lead to a displacement in relation to a second web strand. The friction of the individual web strands with one another, which results from them being brought together, dampens, among other things, such effects. Practice has shown that these deviations are negligible for the cutting positions, so that it may be assumed without a great error that the individual web strands will no longer be displaced after they have been brought together.

To determine the cutting positions of web strands, which are brought together into a strand to be bound in a rotary printing press and are cross-cut, a measured value for the cutting position of the web strands in the strand to be bound is recorded and is used to determine the cutting positions of the web strands. A measured value for the cutting position of the outermost web strand in the strand to be bound is preferably recorded at a short distance in front of the cutting cylinder. This measured value represents the common deviation of the cutting position of all web strands in the strand to be bound. This measured value can be determined by means of an optical sensor.

In order for the individual web strands to have the same cutting positions with one another in relation to the cutting cylinder, one individual measured value each is recorded for the cutting positions of the web strands before bringing together for each of the web strands. Optical sensors may be used for this purpose as well, which detect the printing style or optionally an optical reference mark and consequently do not depend on special reference marks, e.g., magnetic marks. The individual measured values and the common measured value recorded in the strand to be bound are used to determine the cutting positions of the web strands. Thus, the present invention connects the use of optical sensors, which makes a special 10J reference mark unnecessary, with the possibility of detecting changes in the cutting position up to a short distance in front of the cutting cylinder. Since only one sensor is needed at a point of the path of the web, there are no design problems. The maintenance, which is often necessary in the case of sensors, remains simple and clear.

Provisions are made in a special embodiment of the present invention for two or more strands to be bound being brought together. Each of the cutting positions of the web strands of the strands to be bound is now determined according to the above-described process. Web paths of different lengths, which result in practice during the bringing together of two or more strands to be bound, lead to various disturbances in the cutting position, which are taken into account with the process according to the present invention. Their common cutting position can again be preferably determined from the individual measured values for the cutting position of the strands to be bound before they are brought together and from a common measured value for the cutting position of the strands to be bound after the bringing together. This means that the process for determining the cutting positions of web strands that are brought together in a strand to be bound can be analogously applied to a plurality of strands to be bound that are brought together in one unit.

Provisions are made in another embodiment for one strand to be bound or a plurality of strands to be bound being brought together with an individual web strand or a plurality of web strands. The cutting positions of the web strands are determined analogously.

Only crop mark control units that can change the cutting positions of the web strands before the individual web strands are brought together are preferably used. Deviations from the common cutting position of all the web strands brought together in one strand to be bound, which are measured at a short distance in front of the cutting cylinder, are used for synchronous control of the control units in the individual web strands. A common deviation of the cutting positions of the web strands, measured in the strand to be bound, is thus corrected individually in the web strands.

To start up the rotary printing press, the cutting positions are preferably set by hand. The cutting positions of the web strands among one another and the cutting position of the web strands in the strand to be bound can be set simultaneously. The printer measures the individual deviations of the cutting positions of the web strands from a finished product, which he removes behind the cutting cylinder. Control values for the register control units of the individual web strands are determined from these measured values and are preset manually. This procedure may have to be repeated several times in order to obtain the desired result. If the cutting positions of the web strands and the cutting position of the entire strand to be bound are within the required tolerance, the control is switched on.

The sensors respond either to the printing style or to special marks, so-called register marks or crop marks. These are optical reference marks, which are always printed along in the same area within the type area. A sensor preferably measures a light-dark diagram of the printing styles, which pass by the sensor periodically.

During the first revolution of the folder after the switching on, a brightness value is measured by the sensor at each angle increment of an incremental transducer mounted at the folder. This sequence of brightness values is used as a reference and is stored. The brightness value is again measured during each further revolution of the folder at each angle increment. The newly recorded sequence of brightness values is compared with the sequence used as a reference. If the cutting position of the images on the paper web has not changed meanwhile at the sensor, the newly recorded sequence exactly agrees with the sequence used as a reference. If there has been a shift, the extent to which the newly recorded sequence must be displaced in relation to the sequence used as a reference for the two sequences to agree is determined. Changes in the cutting positions of web strands at the sensors can thus be recognized as displacements of the continually newly recorded measured value sequences in relation to the reference sequences stored. A measured value sequence will hereinafter be called a measured value for the cutting position.

A device for determining cutting positions of web strands which are brought together in a rotary printing press into a strand to be bound and are cross cut comprises a sensor, which records a measured value for the cutting position of the web strands in the strand to be bound. This sensor detects the cutting position of the outermost web strand of the strand to be bound, which agrees with the cutting position of all other web strands in the strand to be bound if the cutting position of the individual web strands were set according to the present invention already before they are brought together such that all web strands of a strand to be bound are in the same cutting position with one another in relation to the cutting cylinder before they are brought together. The sensor in the strand to be bound should be preferably placed as close as possible to and in front of the cutting cylinder. One sensor each, which determines an individual measured value for the cutting position of the web strand, is provided individually for each web strand in the area located before the area in which the web strands are brought together. This sensor should be preferably arranged as close as possible to and in front of the area in which the web strands are brought together, e.g., by means of a collecting roller.

Sensors that are able to detect the cutting positions of the web strands without an auxiliary mark printed additionally are preferably used. These are sensors that optically scan the printing style on the printed web. Such a sensor is used both to determine an individual value for the cutting position of a web strand before the web strands are brought together and to determine a value for the cutting position of the web strands in the strand to be bound. The use of such sensors is known. Maintenance is considerably facilitated by the possibility of using the same type of sensor.

It is also possible to use preferably sensors that detect print marks which are arranged within the type area. This is especially advantageous if one page with different contents is to be printed without stopping the press. This property is used especially where, e.g., a plurality of regional editions of a newspaper are printed. Part of the contents usually remains the same between the individual editions and another part of the contents is changed. The changeover of the production from one edition to another edition shall happen with the least effort possible. This is not a problem in the case of webs that are not subjected to a change in contents, because the production conditions do not change at the time of the change from one edition to another. In the case of webs in which the contents change, the cylinders printing before the change of the edition are stopped and other cylinders, which are equipped with the printing plates intended for the next partial edition, are engaged.

The cutting position of the webs with a change in contents can be preferably set by providing print marks that are always printed along in the same area within the corresponding type area at least on the pages whose contents change from one edition to the next. The desired angular position of the cutting cylinder during the passage of the mark at the sensor is the same for all editions. The cutting position of the webs with a change in contents can be further controlled right at the beginning of the production of a different edition without switching off the control. The sensors used do not need to be set to the changed printing style of the new edition, because they detect print marks that are printed in the same area in all editions.

The signals of the sensors are integrated in a central control. A control device of its own, which compares the measured signal of the sensor with a set point, which may also consist of a plurality of set point components, and processes it, and sends an adjusting value to the control unit associated with it, is preferably associated with each sensor. The control device may be formed by a controller. A set point transducer is preferably associated with each controller.

To determine the cutting position of web strands, the controller of the common measured value is preferably connected directly or indirectly to each controller of the individual measured values. The common deviation of the cutting position of the web strands in the strand to be bound is thus also taken into account.

Provisions are made in a special embodiment of the present invention for control units for changing the cutting positions of the web strands being individually associated with the controllers of the individual measured values only.

Deviations of the cutting position of the web strands measured in the strand to be bound at a short distance before the cutting cylinder are taken into account as a common correction value in all controllers of the individual measured values. The correction value is preferably sent to the controllers of the individual measured values as a common set point component.

In another preferred embodiment, a register for the strand to be bound is integrated in the strand to be bound between the former and the cutting cylinder in addition to the register mechanism of the web strands. The cutting position of the web strands in the strand to be bound can thus be set in the strand to be bound. The register for the strand to be bound is used for the first setting of the cutting position before the control. The register for the strand to be bound is not adjusted during the operation.

A register for the strand to be bound is likewise used in another preferred embodiment. The deviation of the cutting position of the web strands in the strand to be bound, which is measured by the sensor for the strand to be bound, is not returned to the controllers of the web strands here. Changes in the cutting position of the strand to be bound, which arise between the web strand sensors and the sensor for the strand to be bound, are compensated with the control units in the register for the strand to be bound during the operation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
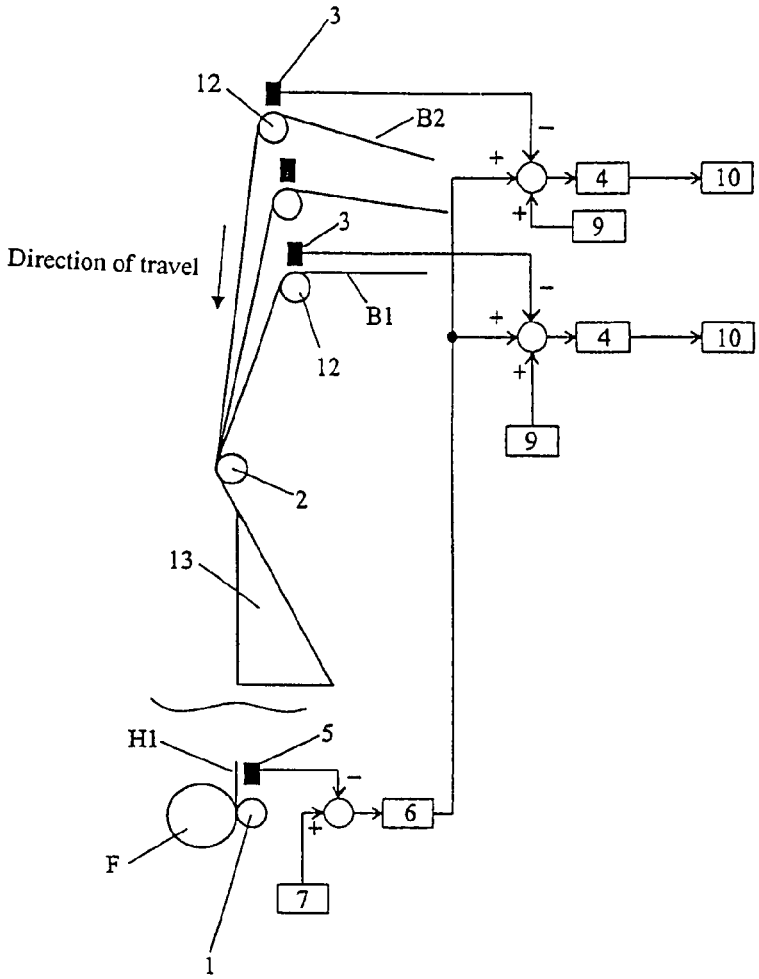
FIG. 1 is a schematic view showing an arrangement for determining the cutting positions of web strands in a rotary printing press.

Referring to the drawings in particular, in a rotary printing press, a web to be printed on is unwound from a roll and it passes through the printing mechanism or a plurality of printing mechanisms. The cutting positions of web strands are set, among other things, in an adjoining register mechanism. This is done by means of movable rollers or bars, which extend or shorten the paths of the paper web. A distinction is made between the main register and the secondary register. It is common practice to print on broad paper webs that are subsequently cut lengthwise, as a result of which the individual web strands are formed. The main register changes the paths of the paper webs before the lengthwise cutting, and the secondary register after the lengthwise cutting.

FIG. 1 shows two web strands B1, B2, which, arriving from the register mechanism, are brought together at a collection roller 2 via former intake guide rollers 12. A third web strand is shown in the figure. Even more web strands may be brought together in practice. The present invention can also be advantageously applied to only two web strands that are to be brought together. Beginning from the collection roller 2, the web strands B1, B2 brought together form a strand to be bound H1. This runs over a former 13 and into a folder F with a cutting cylinder 1. The strand to be bound is cut there at right angles to the direction of travel of the paper webs. Considerable distances must be covered in practice between the former 13 and the cutting cylinder 1. This is indicated by an interruption in the figure.

A measured value for the cutting position of the web strands in the strand to be bound H1 is determined by a sensor 5 for the strand to be bound. The sensor 5 for the strand to be bound is preferably arranged as close as possible to and in front of the cutting cylinder 1 in the direction of travel. The accuracy of the determination of the cutting position is increased as a result. The common cutting position deviation of the web strands B1, B2 in the strand to be bound H1 is measured with the sensor 5 for the strand to be bound. An optical sensor, which scans the printed pattern of one of the outer web strands of the strand to be bound H1, is preferably used. As an alternative to such a crop mark control with printed pattern detection, print marks that are printed along within the type area can be detected by the sensors. These print marks are preferably printed on all pages always in the same area. Such marks are especially preferably printed on pages whose contents change within one production.

To determine and control the cutting positions of the individual web strands B1, B2 among one another, measured values are determined by web strand sensors 3 before the web strands B1, B2 are brought together. They are preferably arranged as close as possible to the area in which the web strands are brought together, in front of the collection roller 2. The web strand sensors 3 are arranged above the former intake guide rollers 12 in the exemplary embodiment. Optical sensors may be preferably used in this case as well.

Figure 2:
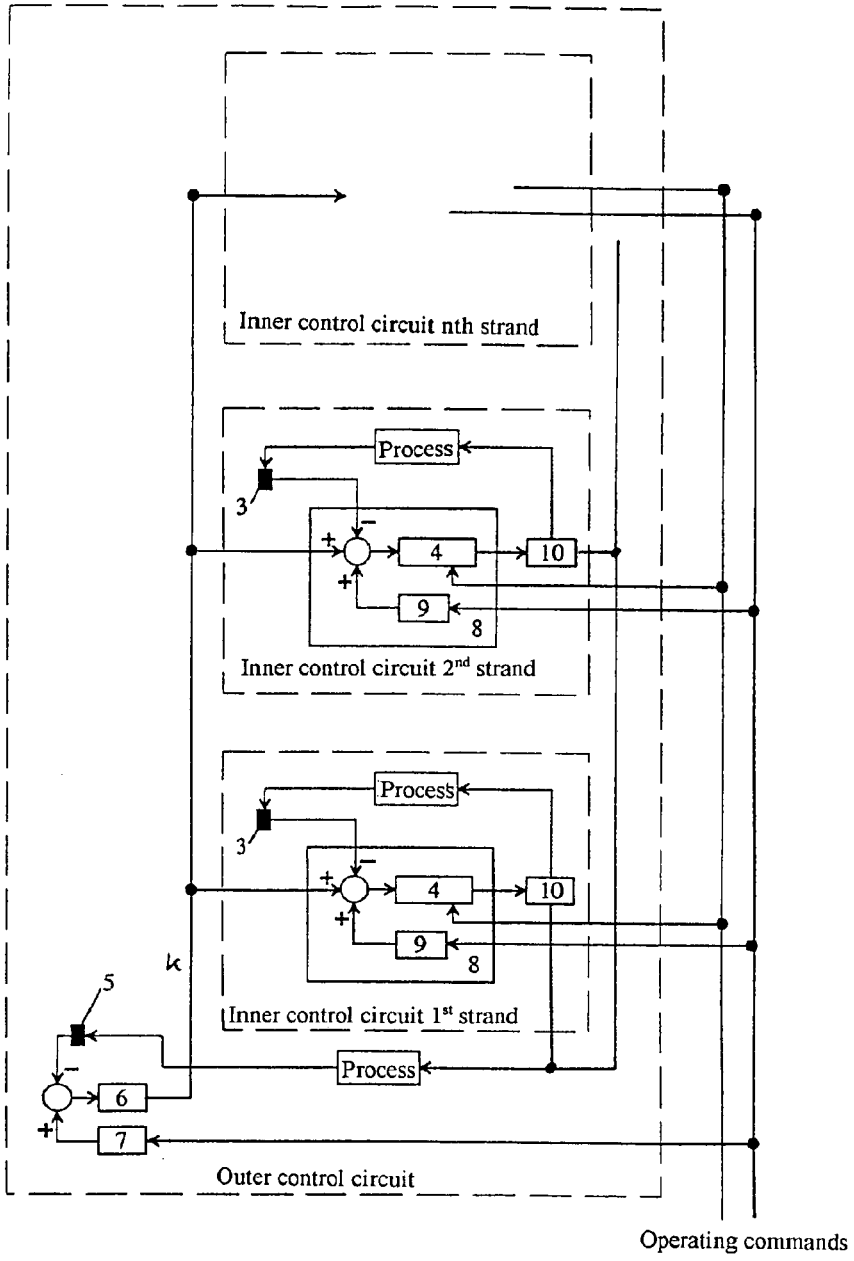
FIG. 2 is a schematic view showing the arrangement of the control circuits for determining the cutting positions of web strands.

FIG. 2 shows the design of the control circuits for determining and controlling the cutting positions of the web strands. All sensors are directly associated with a computing unit 8. The computing unit 8 preferably comprises inputs for the set points and the measured value, a set point transducer 9, a controller 4 and an output to the control unit 10. A reference value, which is measured by the associated sensor at the time of the switching on of the printing press, is also stored in a computing unit 8. Operating commands can be preset for the computing units 8 via a bus system. Distinction is made according to the present invention between two types of control circuits, namely, one inner control circuit per web strand and one outer control circuit per strand to be bound. The relatively rapidly responding inner control circuit has the corresponding web strand sensor 3, a computing unit 8 and a control unit 10. The control unit 10, which is a mechanism for adjusting the main or secondary register, may be a conventional register unit or also a set of driven rollers or cylinders, which displace their angular positions in relation to a guide angular position, as in the single-drive technique. The control unit associated with a particular controller can extend or shorten the path length of a web strand and thus change the cutting position of this web strand. The control unit controls the process, whose state is in turn detected by means of the sensors 3, 5.

The outer control circuit, which responds relatively more slowly than the inner control circuit, has a sensor 5 for the strand to be bound, a controller 6 associated with a set point transducer 7, and the inner control circuits. In the preferred embodiment, no control unit is associated with the controller 6. Only the inner controllers 4 act directly on the control unit 10 associated with them. The controller 6 is preferably connected to each of the controllers 4. This can be brought about especially preferably via a bus, to which all computing units 4, 6 are connected. In particular, the controller 6 is connected to all other controllers. Common values are exchanged via the bus between sensors and controllers or correction values K are exchanged between the controllers. Another advantage of the bus system is that telegrams for operating and programming the computing units 8 (operating commands) as well as preset set points 7, 9 can be sent as well. The dynamics of the individual controllers can also be influenced by means of the operating commands. The connected computing units can be programmed such that they selectively process values, i.e., they accept only values from a defined sensor or another controller.

The cutting positions of the individual web strands are controlled in the inner control circuits such that all web strands have the same cutting position. A deviation of the cutting position from a reference value is measured here. An individual reference value is set for each controller at the time of the start-up of the rotary printing press. The deviations are processed in the controllers 4 into control signals for the register control units and are sent to the control units 10, which interfere with the process in a controlling manner. The inner control circuit controls rapidly compared with the outer control circuit in order not to produce an unstable system when the inner control circuit is unable to follow the dynamics of the input values. The inner control circuit is provided with a greater dynamics than the outer control circuit. It is thus guaranteed at each point in time that all web strands B1, B2 at the web strand sensors 3 have the same cutting position among one another.

A measured deviation of the cutting position in the sensor 5 for the strand to be bound, as a deviation of the measured value from the reference value, is processed by means of the slow outer control circuit into a correction value K, which is sent, e.g., via the bus system, to all inner controllers 4 as a set point component. The set point of a controller 4 is composed of the individual preset set point 9 and the common correction value K. Each controller 4 determines individual control signals for the register control unit associated with it from the set points, the reference values and the individual measured values of the web strands. The deviation of the cutting position of the strand to be bound H1 is corrected in the web strands B1, B2 by means of the connected control units 10. This structure is called "cascade control" in control engineering. The composition and the comparison of the input values before the controllers 4, 6 is shown in the figures.

At the time of the start-up of a rotary printing press, the cutting positions of the web strands in relation to one another and the cutting position of the web strands brought together in a strand to be bound are set manually with the web strands running at a low speed. If the cutting position as a whole has been set correctly, the values measured by means of the web strand sensors 3 and the sensor 5 for the strand to be bound are stored as reference values for the further course of the production. Beginning from this point in time, all variations of the cutting position are automatically compensated by the control. However, it is preferably also possible to manually send preset set points 7, 9 to the controllers 4 and 6 via the set point transducers 7, 9. A set point can be advantageously preset at a control station or even on a control panel, and this set point is then passed on to the set point transducers 7, 9 via an internal system, preferably a bus system.

Figure 3:
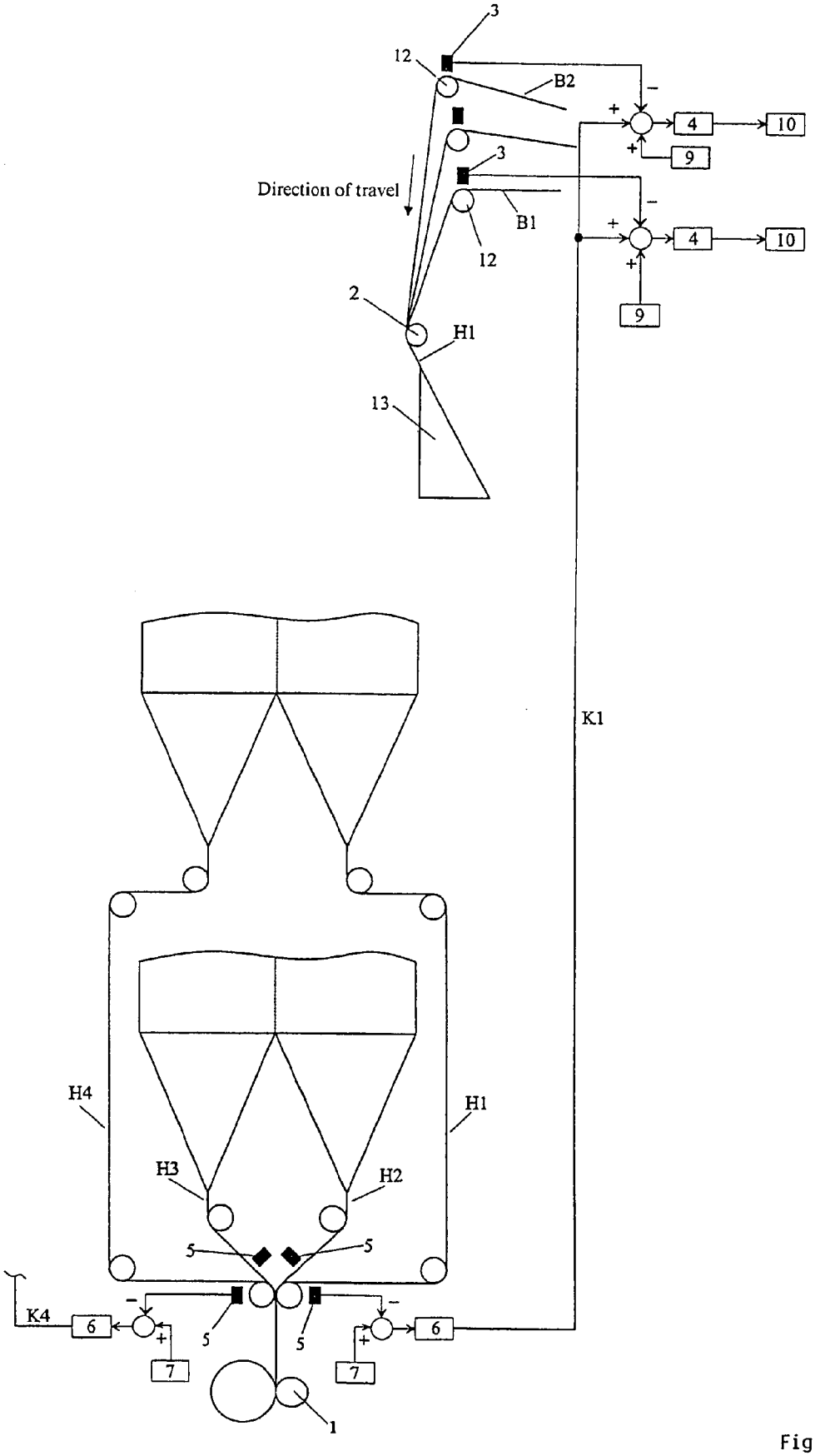
FIG. 3 is a schematic view showing an arrangement for determining the cutting positions of web strands during the bringing together of four strands to be bound.

FIG. 3 schematically shows the design of the process according to the present invention for determining cutting positions of web strands for the case in which four strands to be bound are brought together. It may also be necessary in practice to bring together fewer or more strands to be bound. The device and the process described can be correspondingly adapted in this case. As is apparent from the figure, the strands to be bound may sometimes cover greatly different delivery distances. The control circuits for the strands to be bound H2, H3 and H4 are not shown in the figure. Their design is analogous to that of the control circuits of the strand to be bound H1, and this is in turn analogous to the control circuits described in FIGS. 1 and 2. The cutting position relative to the cutting cylinder 1 is determined and controlled individually for each strand to be bound H1, H2, H3, H4

Correct assignment of the measured values and control signals must be ensured in the case of the use of a central information network, especially a bus system. For example, the controllers 4, which act on the cutting position of the web strands B1, B2, which are brought together into a strand to be bound H1, may process only correction values K1 that arise from a deviation measured in the strand to be bound H1. Correction values K2, K3, K4 for the strands to be bound H2, H3 and H4 must not be taken into account here. This also applies analogously to the other strands to be bound H2, H3 and H4. To make FIG. 3 clearly understandable, the determination of the correction values K2 and K3 is not shown. It is performed analogously to the determination of the correction values K1, K4. The computing units or controllers 4 can be programmed such that they can selectively process values, i.e., they accept values from a defined controller and/or sensor only and discard all others. If a common bus system is used, an acceptance address is specified for a controller from a control panel or from a PC, etc., which are also connected to the bus. It is even better to read the data necessary for the determination of the correct acceptance address from the press control and to process it automatically by means of the PC, etc., and to send it to the controllers. The controllers 4 can thus use, e.g., the sender address of a correction value K as a selection criterion. Another possibility is to directly assign a piece of information to one or more recipients.

Figure 4:
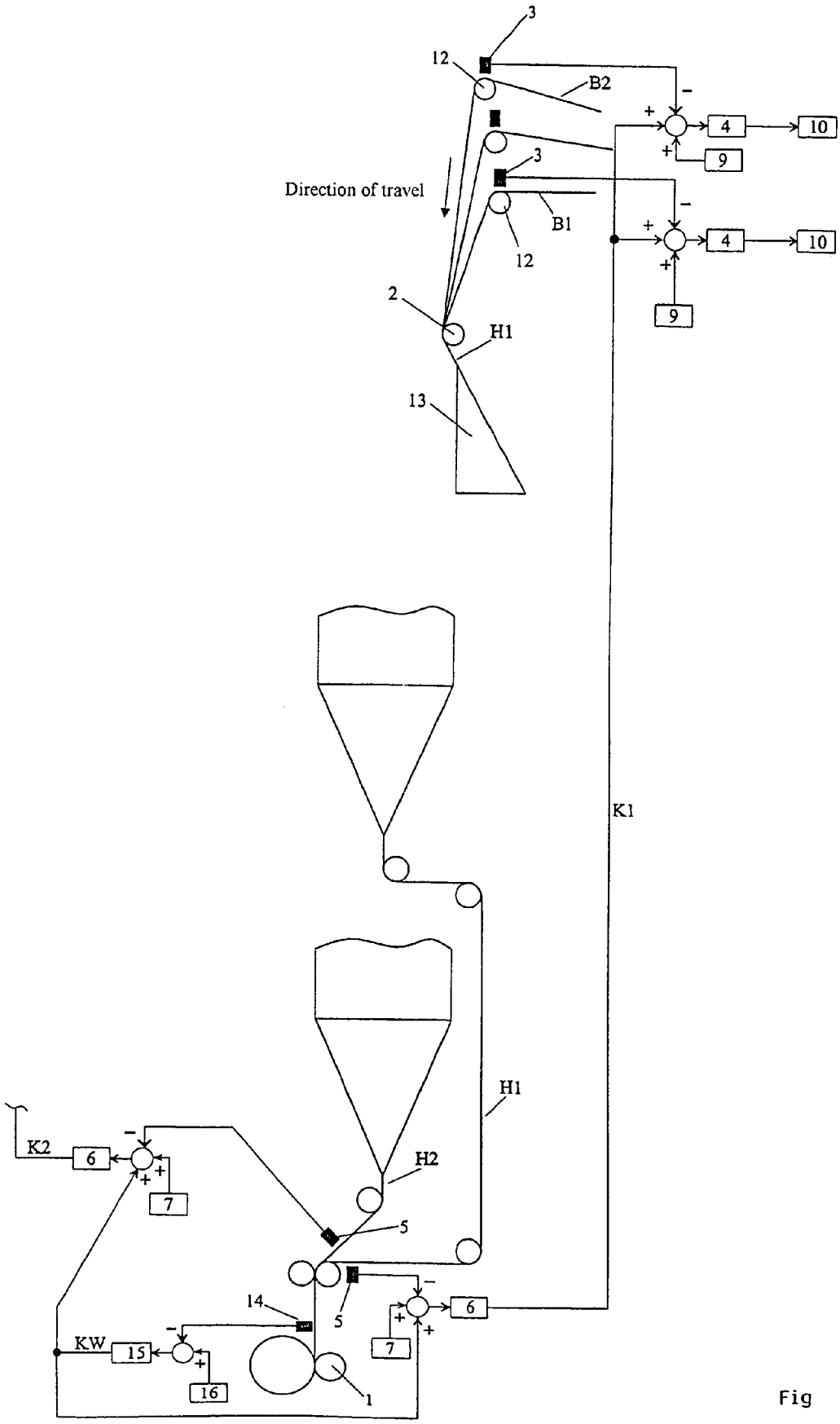
FIG. 4 is a schematic view showing an arrangement for determining the cutting positions of strands to be bound during the bringing together of two strands to be bound.

FIG. 4 shows the above-described determination and control of the cutting position during the bringing together of web strands into strands to be bound for the case of the bringing together of a plurality of strands to be bound. For example, two strands to be bound H1 and H2 are brought together in FIG. 4.

The cutting positions of the web strands B1, B2 are determined individually before they are brought together. An inner control circuit comprises a web strand sensor 3, a controller 4 and a control unit 10. The common deviation of the web strands B1, B2 in the strand to be bound H1 is determined in the strand to be bound H1 with the sensor 5 for the strand to be bound and is processed by the controller 6 into a correction value K1. This correction value K1 is sent as a set point component to the controllers 4 that act on the web strands B1, B2 that form the strand to be bound H1. A middle control circuit is formed.

Via another sensor 14 for the strand to be bound, which is arranged after the point at which the strands to be bound H1, H2 are brought together, the outer control circuit detects the common cutting position of the strands to be bound H1, H2 brought together. A controller 15 associated with this sensor processes a deviation into a correction value KW, which is sent back as a set point component to the controllers 6 of the sensors of the strands to be bound H1, H2 for the strand to be bound. Analogously to the other controllers, a set point 16 may be preset for the controller 15. The correction value KW of the outer control circuit is also integrated in the correction values K1 and K2 via the controllers 6. These in turn act indirectly on the control units 10 via the controllers 4. A double cascade is formed.

The design of the present invention described in connection with FIG. 1 is expanded by a register for the strand to be bound in FIG. 5. The register for the strand to be bound with its control unit 17, which acts on the cutting position of the web strands in the strand to be bound by changing the path of the web, is integrated between the former 13 and the cutting cylinder 1. To set the rotary printing press by hand, the printer first uses the register for the strand to be bound to set a capture range of the cutting position. The cutting position is roughly preset if the capture range has been reached. The fine tuning of the cutting position is subsequently performed by means of the main and secondary registers and the register for the strand to be bound. The cutting position is controlled after the controllers 4, 6 have been switched on as was described above, without the register for the strand to be bound being adjusted.

Figure 5:
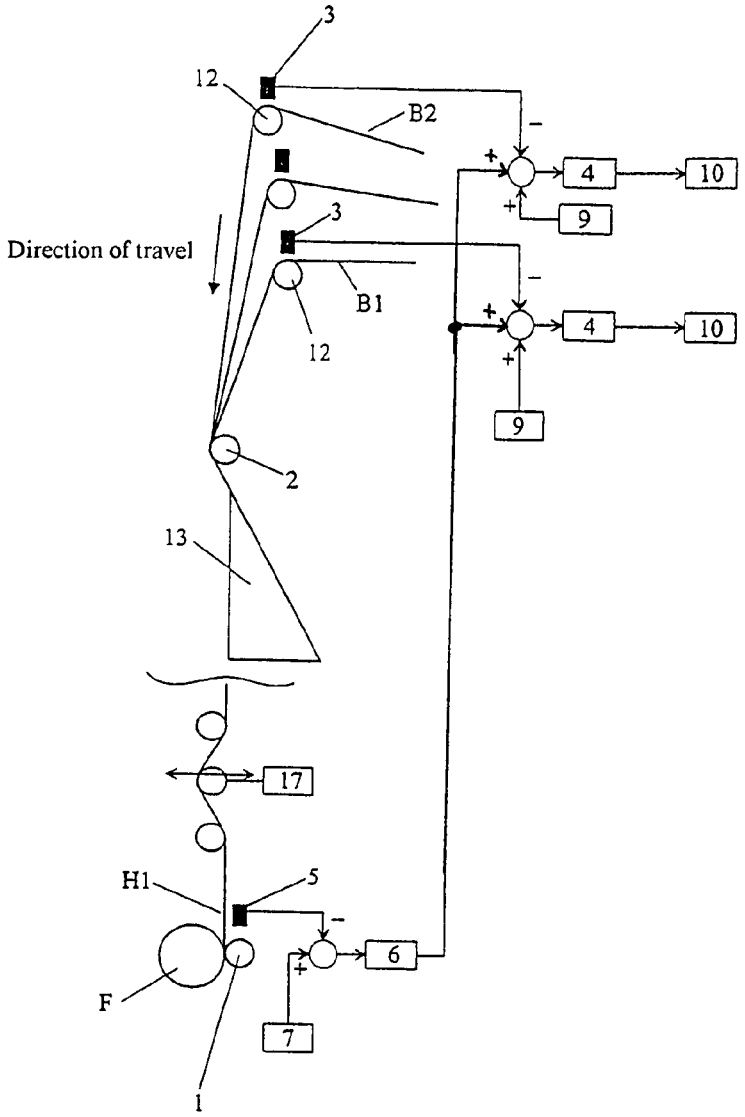
FIG. 5 is a schematic view showing an arrangement for determining the cutting positions of web strands in a rotary printing press with integrated register for the strand to be bound.
Figure 6:
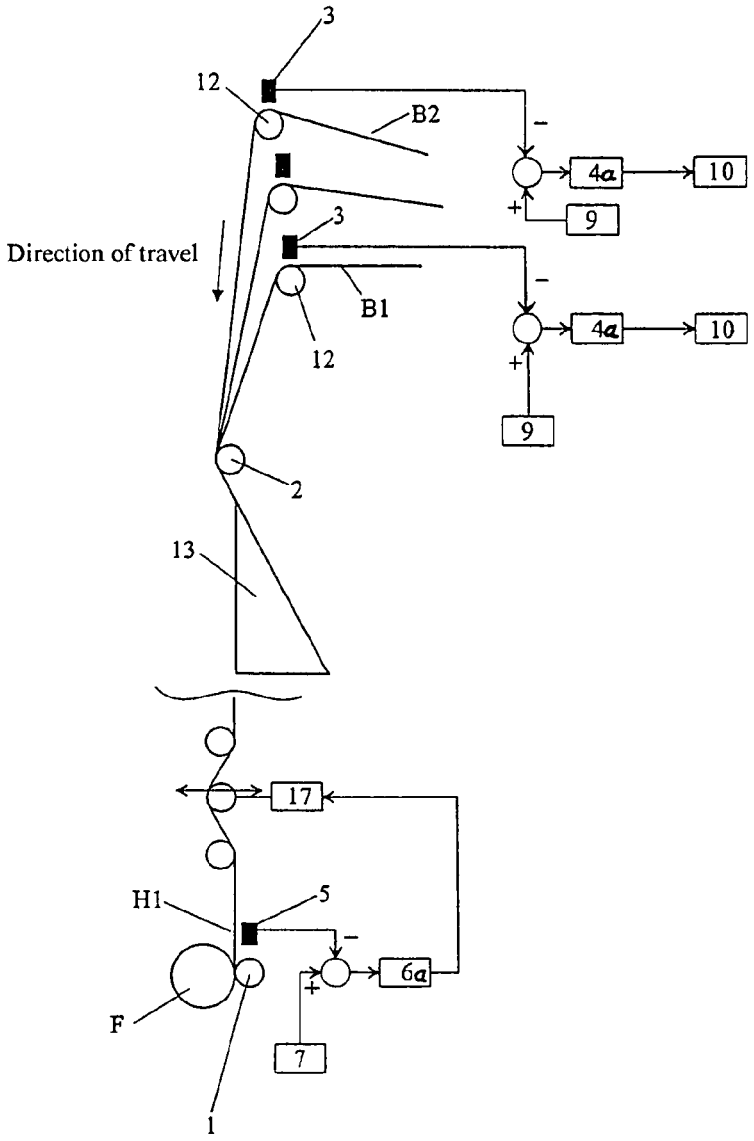
FIG. 6 is a schematic view showing an arrangement for determining the cutting positions of web strands with control of the main and secondary registers and the strand to be bound.

FIG. 6 corresponds to FIG. 5, with the difference that the cascaded control is interrupted. A deviation of the cutting position of the web strands in the strand to be bound, which is measured in the sensor 5 for the strand to be bound, is processed in the controller 6*a*, as was described with respect to the controller 6 above. The control unit 17 is directly associated with the controller 6*a*. The correction value of the controller 6*a* is now sent to the control unit 17 of the register for the strand to be bound. The measured values of the individual strands for the cutting positions of the web strands B1, B2 are processed by the controllers 4*a* into adjusting signals for the control units 10 associated with them. Independent control circuits are formed for the individual web strands B1, B2 and an independent control circuit is formed for the common strand to be bound H1.

While specific embodiments of the invention have been shown and described in detail to illustrate the application of the principles of the invention, it will be understood that the invention may be embodied otherwise without departing from such principles.

What is claimed is:

1. A process for determining the cutting positions of a plurality of web strands, wherein said web strands are brought together into a bounded strand in a rotary printing press and are cross-cut, said process comprising the steps of:

a) bringing together said web strands into a bounded strand;

b) recording a common measured value for said cutting position of said web strands in the bounded strand;

c) recording, for each of said web strands, an individual strand measured value for said cutting positions of said web strands before bringing said strands together;

d) using said recorded common measured value in a common control device to determine said cutting positions of said web strands in said bounded strand; and e) forming a common adjusting signal for said bounded strand in said common control device by comparing said common measured value with a set point value, wherein for each web strand, an individual adjusting signal is formed, and wherein said common adjusting signal and said respective individual strand measured value are used to form said respective individual adjusting signal.

2. A process in accordance with claim 1, wherein said bounded strand and another bounded strand are brought together and the cutting position of said other bounded strand is also determined by using said recorded common measured value to determine the cutting positions of said web strands, including determining the cutting positions of said web strands from said individual strand measured values and said common measured value determined for said web strands of said other bounded strand in said other bounded strand.

3. A process in accordance with claim 1, wherein said bounded strand and an individual web strand are brought together and the cutting position of said individual web strand is also determined by using said recorded common measured value to determine the cutting positions of said web strands, including determining the cutting positions of said web strands, from said individual strand measured values and said common measured value for said individual web strand.

4. A process in accordance with claim 1, wherein said common measured value recorded in said bounded strand is used for a synchronous control of a register control unit for said web strands.

5. A process in accordance with claim 1, wherein values for the cutting positions are set manually at a start-up time of the rotary printing press and measured values for the cutting positions are stored as reference values.

6. A device for determining cutting positions of web strands, which are brought together into a bounded strand, in a rotary printing press and are cross-cut, said device comprising:

a) at least one sensor for said bounded strand wherein a common measured value for the cutting positions of said web strands in said bounded strand is recorded;

b) a plurality of web strand sensors for individually recording an individual strand measured values for the cutting positions of each of said web strands before said web strands are brought together;

c) a common control device having a set point transducer, wherein said common control device forms a common adjusting signal for said bounded strand by comparing a set point value from said set point transducer and said common strand measured value; and d) an individual control device for each web strand, which forms an individual adjusting signal for said respective web strand, using said common adjusting signal and said respective individual strand measured value.

7. A device in accordance with claim 6, wherein said common measured value for the cutting positions of said web strands in said bounded strand is recorded in said bounded strand by said sensor for said bounded strand, on a single web strand of said bounded strand.

8. A device in accordance with claim 6, wherein said web strand sensors and said sensor for said bounded strand are an optical scanner for detecting a printed pattern.

9. A device in accordance with claim 6, wherein said web strand sensors and said sensor for said bounded strand detect a set of optical print marks, which are always printed along in a same area on a plurality of pages of different printed products.

10. A device in accordance with claim 6, further comprising:

a control device, wherein a common measured value for cutting positions of said web strands in said bounded strand and said individual strand measured values for said cutting positions of said web strands are sent to said control device and said control device forms adjusting signals individually for web strands from said common measured value and said individual strand measured values.

11. A device in accordance with claim 6, wherein said individual control device is assigned to each web strand and each individual control device forms an adjusting signal for its assigned individual web strand.

12. A device in accordance with claim 11, wherein said individual strand measured values for the cutting positions of said web strands are sent to said individual control devices for said individual web strands as controlled variables.

13. A device in accordance with claim 6, wherein said control device includes:

a common control device which forms an adjusting signal for said bounded strand; and a plurality of individual control devices, each individual control device forms an individual adjusting signal for each said web strands, wherein said common measured value is sent to said common control device to form an adjusting signal for said bounded strand, and said individual strand measured values are sent to said individual control devices which form individual adjusting signals for said web strands.

* * * * *